United States Patent [19]

Olson

[11] 4,139,174

[45] Feb. 13, 1979

[54] CLOTHESLINE CLIP FOR GARMENT HANGERS

[76] Inventor: Shirley A. Olson, 1065 Nelson Dr., St. Paul, Minn. 55112

[21] Appl. No.: 793,002

[22] Filed: May 2, 1977

[51] Int. Cl.[2] ..... B42F 13/00

[52] U.S. Cl. ..... 248/317; 248/300

[58] Field of Search ..... 248/214, 300, 317, 339, 248/340, 341; 24/129 B; 223/85; 403/395, 397

[56] References Cited

U.S. PATENT DOCUMENTS

| | | | |
|---|---|---|---|
| 858,555 | 7/1907 | Altick | 24/129 B |
| 1,405,298 | 1/1922 | Dahl | 248/300 |
| 1,623,919 | 4/1927 | Hagen | 248/317 |
| 2,915,274 | 12/1959 | Gustitus | 248/317 |
| 2,980,383 | 4/1961 | Anderson et al. | 248/317 |
| 3,184,204 | 5/1965 | Dachinger | 248/323 |
| 3,193,235 | 7/1965 | Jensen | 248/317 |
| 3,253,813 | 5/1966 | Schwab | 248/317 X |
| 3,792,804 | 2/1974 | Ponzo | 248/340 X |
| 4,019,707 | 4/1977 | Quinn et al. | 248/228 X |

FOREIGN PATENT DOCUMENTS

| | | | |
|---|---|---|---|
| 2303507 | 10/1976 | France | 248/317 |

*Primary Examiner*—Lawrence J. Staab

*Attorney, Agent, or Firm*—Peterson, Palmatier, Sturm & Sjoquist, Ltd.

[57] ABSTRACT

A one-piece clip of plastic includes a U-shaped section forming a groove for receiving a clothesline therein. One of the legs of the U-shaped section is longer than the other to assist in guiding the clothesline into the groove. Extending angularly from the shorter leg of the U-shaped section is a wing section. The U-shaped and wing sections have slots therein for receiving the hook of a conventional garment hanger.

4 Claims, 4 Drawing Figures

CLOTHESLINE CLIP FOR GARMENT HANGERS

BACKGROUND OF THE INVENTION

1. Field of the Invention

This invention relates generally to devices for suspending garment hangers from clotheslines.

2. Description of the Prior Art

Various attachments have been devised for suspending garment hangers from clotheslines and the like. For example, in U.S. Pat. No. 3,184,204 granted May 18, 1965, a relatively simple suspension device is disclosed. However, it depends upon the weight of the hanger and any garment hung thereon to resist movement of the device relative to the clothesline. Owing to the fact that garments frequently are very lightweight, the device cannot be counted upon not to shift along the clothesline when lightweight garments are suspended therefrom.

In U.S. Pat. No. 2,980,383 granted Apr. 18, 1961 a device is illustrated which does resist longitudinal movement along the clothesline. However, it requires the use of a rotatable cam which not only increases its cost but requires more time in attaching it to the clothesline.

In U.S. Pat. No. 2,915,274 granted Dec. 1, 1959 a three-hook arrangement is depicted. The hooks span a considerable length of the clothesline and even then with relatively thin lines they do not necessarily keep the device from shifting. To prevent shifting, a roller is employed which can be vertically adjusted for different clothesline diameters.

SUMMARY OF THE INVENTION

Accordingly, the need still exists for a device for suspending garments from clotheslines that will be simple and inexpensive. In this regard, an aim of the invention is to provide a one-piece clip that will not only be simple and inexpensive but which can be easily attached and detached from a clothesline.

Another object is to provide a device of the foregoing character that will not inadvertently come off the clothesline. More specifically, a clip fabricated in accordance with my invention cannot blow off the line irrespective of how brisk the wind happens to be.

Another aim or object of the invention is to provide a clip that will not slide or shift along the clothesline. In this regard, if a clothesline has relatively heavy clothes thereon, then the line slopes or inclines considerably and garments tend to slide downwardly toward the heavy clothes; this situation is obviated when practicing my invention. Also, my clip prevents clothes from shifting along the line due to wind forces. Consequently, my invention assures that the garment hanger will remain at the location on the line where it is intended to remain.

Not only is it an object to prevent blowing off, sliding or shifting along the line, but my invention has for a further object the prevention of skewing which is also caused by wind, skewing resulting in the clothes swinging against each other even though there is no longitudinal shifting involved.

Yet another object of the invention is to provide a clip for suspending garment hangers from clotheslines and the like in which the garment hanger can be removed from the clip without taking the clip off the line.

Still further, another object is to provide a device for hanging clothes from a clothesline which can be used on clotheslines having different cross sections or diameters. In this regard, an aim of the invention is to provide a clip having sufficient resiliency such that it will effectively grip different thicknesses of clothesline.

A further object of the invention is to provide a clip that not only grips the clothesline but which engages the curved hook of a conventional garment hanger at several locations, thereby resisting tilting of the garment hanger. with respect to the attached clip.

Still another object is to provide a compact clip of such small size that a number of such clips can be carried in a person's pocket or carried much like clothespins are now carried.

Briefly, my invention envisages a one-piece clip of strip plastic, such as acrylic, which includes a U-shaped section forming a groove for the reception of a clothesline therein. The resiliency of the U-shaped section enables various sizes of clotheslines to be accommodated in the groove, the legs of the U-shaped section being sufficiently resilient so that they can be spread farther apart for larger thicknesses of clothesline. One of the legs constituting the U-shaped section is longer than the other so as to assist the user in guiding the clothesline into the groove. A wing section extends angularly from the shorter leg of the U-shaped section. Slot portions in the two legs of the U-shaped section plus a slot extending inwardly from the free end of the wing section permit the hook of a conventional garment hanger to be engaged and retained by the clip after it has been placed on a clothesline, the ends of the slots being oriented so that the curved hook bears against the clip at three spaced locations.

DESCRIPTION OF THE PREFERRED EMBODIMENT

Figure 1:
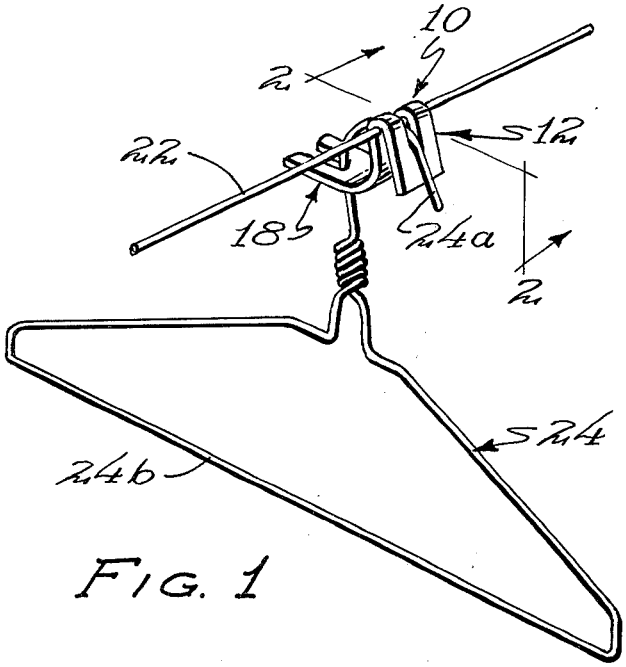
FIG. 1 is a perspective view of my clip in actual use.

My one-piece clip has been deonted generally by the reference numeral 10. The clip 10 is formed from the strip of resilient plastic, preferably a synthetic resin such as acrylic (Lucite or Plexiglass).

Figure 2:
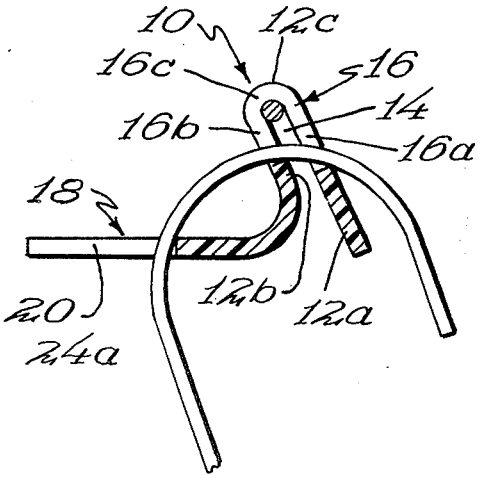
FIG. 2 is a sectional view taken in the direction of line 2—2 of FIG. 1.
Figure 4:
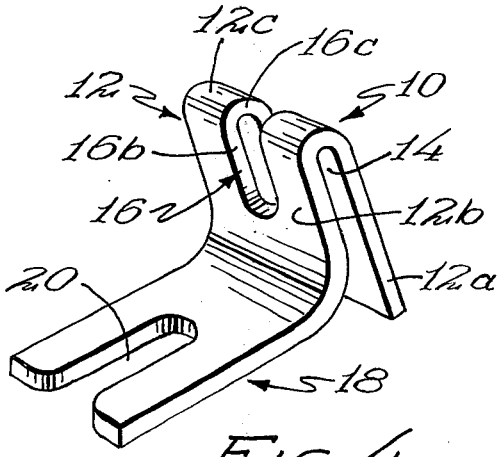
FIG. 4 is another perspective view of the clip, the view being taken at a different angle from that of FIG. 3.
Figure 3:
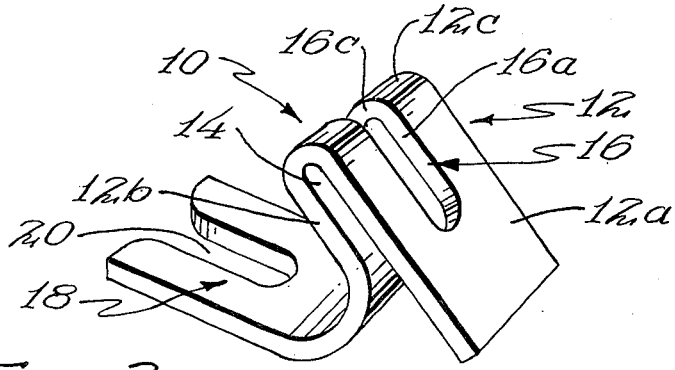
FIG. 3 is an enlarged perspective view of my clip, the clip being oriented in the same position that it appears in FIG. 1.

It will be discerned that the clip 10 comprises a U-shaped section 12 composed of a first leg **12*a*, a second leg 12*b* and a bight 12*c*. The legs 12*a* and 12*b* form a groove 14 therebetween and the leg 12*a* is somewhat longer than the leg 12*b* for a purpose hereinafter explained. The U-shaped section contains a slot 16 having a first portion 16*a* in the leg 12*a*, a second portion 16*b* in the leg 12*b* and a third portion 16*c* in the bight 12*c*. As best seen in FIG. 2, the closed end of the slot portion 16*a* is spaced farther from the bight 12*c* than is the closed end of the slot portion 16*b* in the leg 12*b***. Here again, the reason for this will become clearer as the description progresses.

At this time, attention is directed to an integral wing section 18 projecting angularly from the leg **12*b* and has a slot 20 formed therein which extends inwardly from its free end toward the end of the wing section 18 that is integrally connected to the end of the leg 12*b***.

The clip 10 is intended to engage a clothesline 22 as illustrated in FIG. 1. Suspended from the clip 10 is a garment hanger 24 having a wire hook portion 24*a* and a garment portion 24*b*.

Although the dimensions of my clip 10 are susceptible to variation, it will be helpful to present typical figures. Accordingly, the clip 10 can be fabricated from original plastic strip stock having a length of 3½ inches, a width of ⅝ inch and a thickness of ⅛ inch. The U-shaped section 12 should be somewhat resilient in order to accommodate different clothesline thickness or diameters. More specifically, the groove 14 preferably has a width of ⅛ inch in order to effectively grip relatively thin clotheslines, yet with the proper resiliency the legs 12*a* and 12*b* can be spread farther apart so as to increase the thickness of the groove 14 and thus permit thicker clotheslines 22 to be received in the groove.

From FIG. 2 it will be perceived that the closed end of the slot portion 16*a* is farther from the bight 12*c* than the closed end of the slot portion 16*b*. Started somewhat differently, the closed end of the slot 20 and the closed ends of the slot portions 16*a* and 16*b* all reside on a curve approximately the curvature of the hook portion 24*a*, thereby resulting in the hook portion 24*a* bearing against the clip 10 at three locations.

Having presented the foregoing description, the manner in which my clip 10 is used should be readily understandable. First, the clip is resiliently engaged with the clothesline 22 by guiding the clothesline 22 into the groove 14, the added length of the leg 12*a* facilitating this initial step. Once the clothesline 22 is fully within the groove 14, the user threads the hook portion 24*a* of the garment hanger 24 through the slot 20 and then through the slot portions 16*b* and 16*a* so as to suspend the hanger 24 from the clip 10 as is clearly evident in FIGS. 1 and 2. This can be done with a garment on the support portion 24*b* of the hanger 24 or the garment can be placed thereon after the hook portion 24*a* has been engaged. Also, the garment hanger 24 can be at any time removed from the clip 10 without taking the clip from the clothesline 22. It will be recognized that the hook portion 24*a* provides positive assurance against the clip 10 becoming inadvertently detached, such as from wind forces, for the portion 24*a* passes beneath the line 22, providing obstructive interference with the line as far as any tendency for the clip to blow off.

It will be appreciated that, owing to the resiliency of the U-shaped section 12, the clothesline 22 is firmly gripped in the region of the bight 12*c*. Consequently, there can be no sliding or shifting of the clip 10 along the clothesline 22. Because of the width of the clip 10, any tendency for the hanger 24 to swing or skew about a vertical axis is prevented because the bight 12*c* bears against the clothesline throughout the width of the clip.

Any tendency for the garment hanger 24 to swing about a horizontal axis is resisted by virtue of the three-point contact clearly shown in FIG. 2; hence, tilting of the hanger 24 is substantially eliminated.

I claim:

1. In combination with a clothesline and a clothes hanger having a curved hook portion, a clip comprising a U-shaped section including first and second generally parallel straight legs and a curved connecting bight at one end of said legs forming a groove for accommodating therein a section of said clothesline, and a generally straight wing section projecting angularly away from said U-shaped section, said U-shaped and wing sections having slot portions for accommodating the hook portion of said garment hanger, said slot portion in said first leg extending from a first location in said first leg spaced from said bight towar said bight and said slot portion in said second leg extending from a second location spaced from said bight toward said bight, and in which said slot portion in said wing section extends from a third location spaced from said second leg toward the free end of said wing section, said curved hook portion of said garment hanger extending through said slot portions in said first and second legs beneath said clothesline and engaging the ends of said slot portions at said first, second and third locations.

2. A clip for clothes hangers comprising a U-shaped section including first and second generally parallel straight legs and a curved connecting bight at one end of said legs forming a groove for accommodating therein a section of clothesline or the like, and a generally straight wing section projecting angularly away from said U-shaped section, said U-shaped and wing sections having elongated openings therethrough for accommodating the hook portion of a garment hanger, said opening in said U-shaped section including a slot portion extending from a location in said first leg spaced from said bight toward said bight and a slot portion extending from a location in said second leg spaced from the other end of said second leg toward said bight, said opening in said wing section including a slot extending from a location therein spaced from said other end of said second leg toward the free end of said wind section, said location in said first leg being farther from said bight than said location in said second leg is from said bight.

3. A clip in accordance with claim 2 in which said locations in said first and second legs and the location in said wing section resides on a curved line approximating the curvature of the hook portion of a conventional garment hanger.

4. A clip in accordance with claim 3 in which said first leg is longer than said second leg.

* * * * *